US005780969A

United States Patent [19]

Sakamoto et al.

[11] Patent Number: 5,780,969

[45] Date of Patent: Jul. 14, 1998

[54] GYROTRON APPARATUS INCLUDING REFLECTING CYLINDERS WHICH PROVIDE UNDESIRED WAVE ABSORPTION

[75] Inventors: Keishi Sakamoto, Katsuta; Masaki Tsuneoka; Atsushi Kasugai, both of Ibaraki-ken; Tsuyoshi Kariya, Otawara, all of Japan

[73] Assignees: Kabushiki Kaisha Toshiba, Kawasaki; Japan Atomic Energy Research Institute, Tokyo, both of Japan

[21] Appl. No.: 510,655

[22] Filed: Aug. 3, 1995

[30] Foreign Application Priority Data

Aug. 5, 1994 [JP] Japan ..... 6-184868
Jul. 17, 1995 [JP] Japan ..... 7-180134

[51] Int. Cl.[6] ..... H01J 25/00; H01J 23/54

[52] U.S. Cl. ..... 315/5; 315/5.38

[58] Field of Search ..... 315/4, 5, 5.38; 331/79

[56] References Cited

U.S. PATENT DOCUMENTS 3,392,301 7/1968 Campbell ..... 315/5.38
3,748,513 7/1973 Levin ..... 315/5.38 X
3,852,636 12/1974 Edgecombe ..... 315/5.38 X
3,995,193 11/1976 Horigome et al. ..... 315/5.38
4,705,988 11/1987 Tran et al. ..... 315/5 X
5,187,408 2/1993 Jödicke et al. ..... 315/5
5,266,868 11/1993 Sakamoto et al. ..... 315/5

FOREIGN PATENT DOCUMENTS 289031 12/1986 Japan ..... 315/5.38
4370625 12/1992 Japan ..... 315/5

*Primary Examiner*—Benny T. Lee
*Attorney, Agent, or Firm*—Cushman, Darby & Cushman IP Group of Pillsbury, Madison & Sutro LLP

[57] ABSTRACT

In the gyrotron apparatus of the present invention, the microwave absorbing unit is provided around the insulation cylinder located between the microwave reflecting transmitter and the collector so as to electrically insulate them from each other, and constituting a part of the vacuum chamber. With this structure, the leakage of an unnecessary microwave to the outside through the insulation cylinder, which may occur when the apparatus is operated with a reduced potential of the collector with regard to the transmitter, can be more surely suppressed.

5 Claims, 3 Drawing Sheets

GYROTRON APPARATUS INCLUDING REFLECTING CYLINDERS WHICH PROVIDE UNDESIRED WAVE ABSORPTION

BACKGROUND OF THE INVENTION

1. Field of the Invention

The present invention relates to a gyrotron apparatus having a structure with which a microwave beam can be transmitted and launched while changing its direction in a quasi-optical mode, and more specifically, to a gyrotron apparatus capable of operating with a collector potential which is negative in respect to a body.

2. Description of the Related Art

As conventionally known, a gyrotron apparatus is an electron tube which operates on the principle of the cyclotron maser, and is used as a high-frequency high power source for a band ranged from a millimeter wave to a submillimeter wave. Recently, a gyrotron apparatus having a mode converter for separating the paths of an electron beam and a microwave beam from each other, has been proposed and is used in practice. Such a gyrotron apparatus, as disclosed in the specification of U.S. Pat. No. 5,266,868, issued Nov. 30, 1993, Sakamoto et al., has structure in which a microwave beam, the mode of which has been converted by a VLASOV converter, is transmitted as the direction of the microwave beam being changed by use of several mirrors in a quasi-optical manner, and the microwave output is extracted in a direction different from that of an electron beam, for example, in a lateral direction which is normal to the axis of the tube.

The main body of the tube of such a gyrotron apparatus includes an electron gun for emitting a hollow electron beam, a cavity resonator, a microwave reflecting-type transmitter and a collector, which are located in order along the downstream of the electron beam. In the cavity resonator, with applying a magnetic field, an electron beam interact with electrical field, thus oscillating a microwave. The microwave is transmitted to the microwave reflecting-type transmitter, in which the microwave is mode-converted, and reflected and transmitted by a plurality of high-frequency mirrors, towards a high-frequency wave output window provided in a direction different from the traveling direction of the electron beam. The electron beam which has passed the microwave reflecting-type transmitter is collected by the collector.

Between the microwave reflecting-type transmitter and the collector, a ceramics-made insulation cylinder which serves to electrically insulate these members from each other, and constitutes a part of a vacuum chamber, is provided. In this type of gyrotron apparatus, when it is operated, the collector is maintained at a negative high potential with respect to the body, i.e., those of the cavity resonator and the microwave reflecting-type transmitter, thus making it possible to achieve a high efficiency operation. In this structure, the current of the microwave reflecting-type transmitter and that of the collector insulated from the transmitter can be independently measured. In this case, the withstand voltage of the insulation cylinder should only be a few volts, and therefore the length of the insulation cylinder along its axial direction should only be about 1 to 2 cm.

Regarding the above-described gyrotron apparatus, in order to decrease the speed of an electron beam by sufficiently reduce the potential of the collector with respect to that of the microwave reflecting-type transmitter, and improve the overall energy efficiency, a potential difference of 20 kV to 50 kV must be applied between the collector and the body. In order to achieve this, it is necessary that the length of the insulation cylinder along its axial direction should be about 10 cm or longer. As the material of the insulation cylinder, ceramics is generally used; however, since a microwave is permeable to ceramics, the leakage of microwave from the insulation cylinder, which is likely to occur when the insulation cylinder is lengthy, becomes a serious problem. The oscillated microwave components remaining in the tube without being mode-converted by the mode converter, are leaked from the insulation cylinder and those wavelengths is short so that those exhibit a behavior just as light.

SUMMARY OF THE INVENTION

An object of the present invention is to provide a gyrotron apparatus which can suppress the leakage of microwave from the insulation cylinder to outside without disturbing the electrical insulation between the microwave reflecting-type transmitter and the collector, and which can guarantee a high efficiency operation with safety by reducing the collector potential.

According to the present invention, there is provided a gyrotron apparatus having an insulation cylinder, which constitutes a part of a vacuum chamber, provided between a microwave reflecting-type transmitter and a collector, wherein a microwave absorbing member is provided to surround the insulation cylinder.

In the gyrotron apparatus of the present invention, the leakage of unnecessary microwaves remaining in the tube, from the insulation cylinder to outside, can be surely suppressed without disturbing the electrical insulation between the microwave reflecting-type transmitter and the collector.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
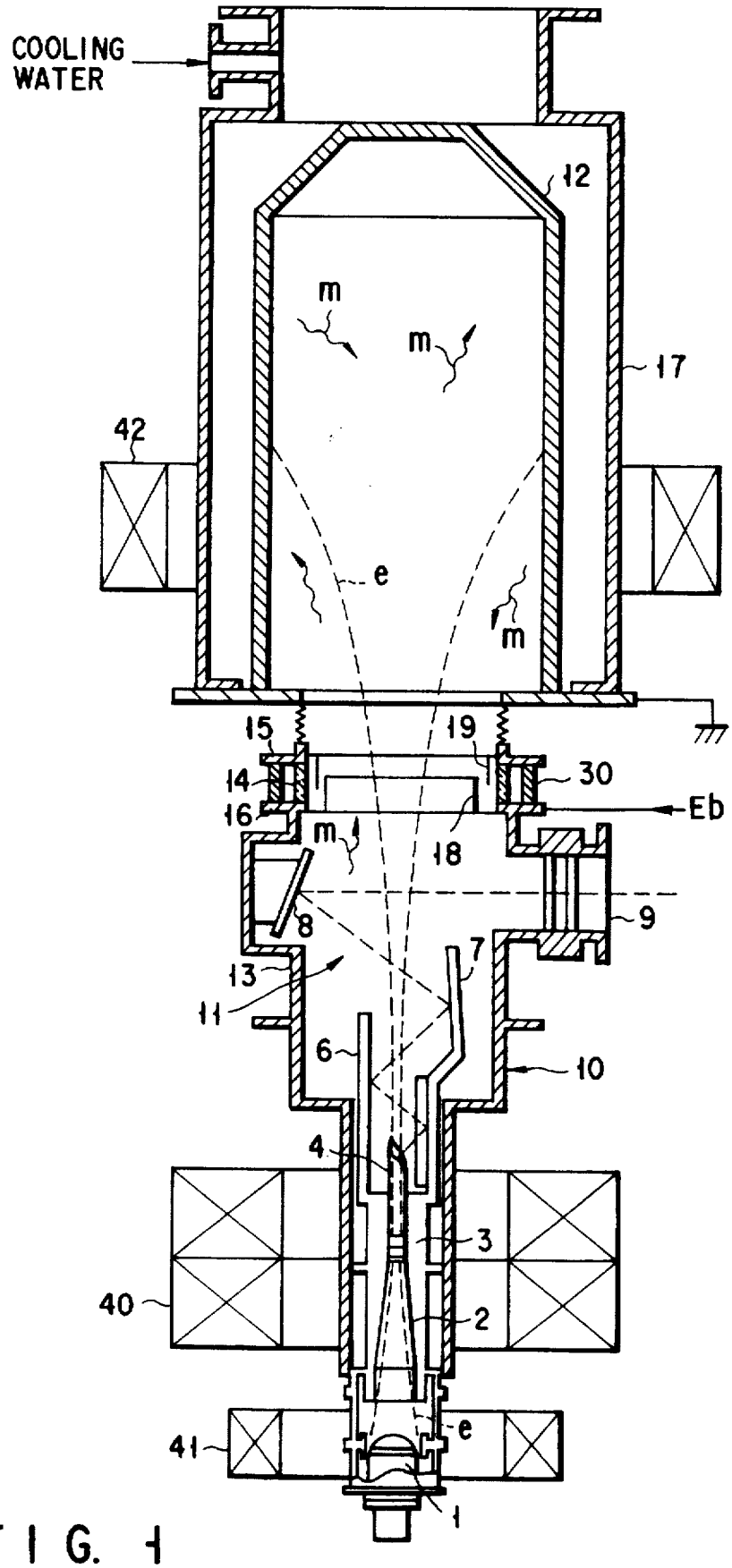
FIG. 1 is a cross section briefly showing a gyrotron apparatus according to an embodiment of the present invention.

Embodiments of the gyrotron apparatus according to the present invention will now be described with reference to drawings. Through these drawings, the same structural members will be designated by the same reference numerals.

Figure 2:
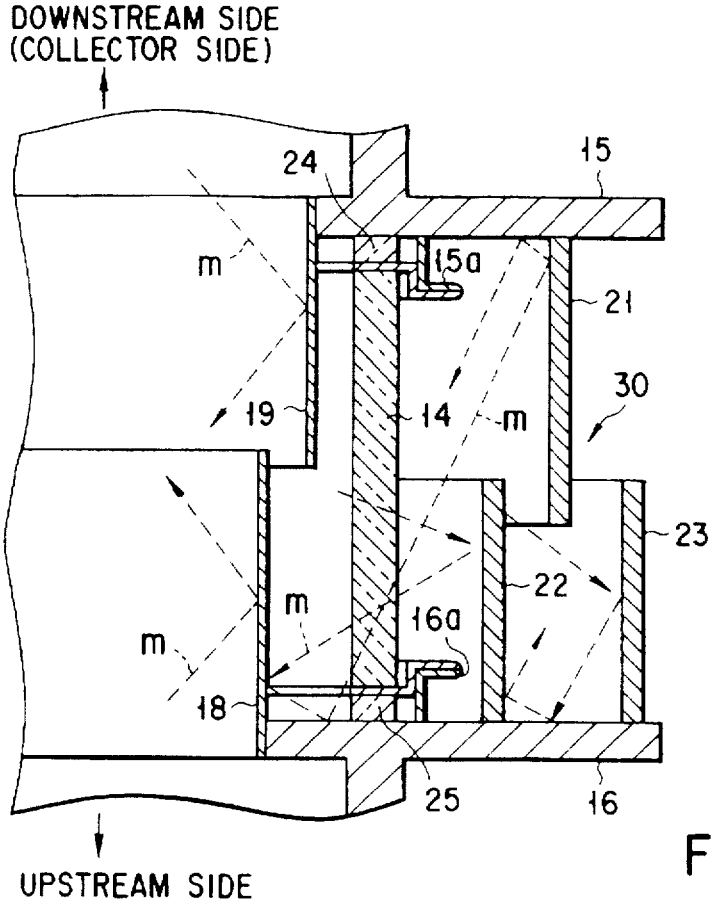
FIG. 2 is a cross section showing an enlarged view of a part of the apparatus shown in FIG. 1.

The gyrotron apparatus according to the present invention, which has a mode converter and wherein its operation is carried out while reducing the collector potential, has a structure such as shown in FIGS. 1 and 2. As shown in FIGS. 1 and 2, this gyrotron apparatus comprises of a tube 10, which is the main body, and electromagnets 40, 41 and 42 which are provided at predetermined positions in the periphery of the tube, and each generate a magnetic field. The gyrotron tube 10 includes an electron gun 1 for emitting a hollow electron beam e (see FIG. 1), and further an electron beam introducer 2, a cavity resonator 3, a mode converter 4, a microwave reflecting-type transmitter 11 and a collector 12, which are arranged along the traveling path of the electron beam. The electron beam introducer 2 is formed so as to reduce its diameter towards the end, and the hollow electron beam, as passing through the introducer, is narrowed along with the shape of the introducer 2, and introduced to the cavity resonator 3. In the cavity resonator 3, the electron beam interacts with the electrical field in the magnetic field applied from the electromagnet 40, thus generating a microwave in the resonator 3. The microwave thus generated is mode-converted by the mode converter 4, and directed to the microwave reflecting-type transmitter 11. The microwave reflecting-type transmitter 11 includes a plurality of high-frequency mirrors 6, 7 and 8 which reflect high-frequency waves and a microwave outputting portion 9, provided in the lateral side of the tube so as to be opposite to these mirrors, for outputting a microwave. The microwave introduced into the microwave reflecting transmitter is reflected by the high-frequency mirrors 6, 7 and 8, and then output from the microwave outputting portion 9. In the meantime, the electron beam e having passed the microwave reflecting-type transmitter 11 is collected by the collector 12 going from the upstream side to the downstream side (see FIG. 2).

In a metal-made vacuum container 13, the cavity resonator 3, the mode converter 4 and the microwave reflecting-type transmitter 11, described above, are provided, and a ceramic-made insulation cylinder 14, which is a part of the vacuum chamber, is provided between the vacuum chamber 13 and the collector 12. The insulation cylinder 14 is joined between a flange 15 of the collector side and a flange 16 of the microwave reflecting-type transmitter side in a vacuum air tight manner, and has a length along the axial direction, which can keep a sufficient insulation against the voltage applied between both flanges when operated at a reduced collector potential with regard to the cavity resonator. In FIG. 2, reference numerals 15*a* and 16*a* each denote a thin metal ring used for sealing and numerals 24 and 25 each denote a ceramic ring used for back-up. A boiler jacket 17 (see FIG. 1) for supplying cool water to the collector is provided so as to surround the collector 12.

Further, as seen in FIGS. 1 and 2 on the inner side of the insulation cylinder 14, that is, the vacuum side of the insulation cylinder 14, two conductor-made microwave reflection cylinders 18 and 19 are fixed respectively to the flanges 15 and 16 in such a manner that there is a gap between the cylinders and parts thereof face to each other. The microwave reflection cylinders 18 and 19 are so located as to prevent unnecessary microwave m, undesirably remaining in the tube due to the diffraction loss of the mode converter or the like, from being leaked to the outside from the tube, and cause the unnecessary microwave m to be reflected towards the inside.

Furthermore, on the periphery side, that is, the atmospheric side of the insulation cylinder 14, a microwave absorbing unit 30 is provided so as to surround the insulation cylinder 14. In the microwave absorbing unit 30 of this embodiment, three cylindrical microwave absorbing members 21, 22 and 23 (see FIG. 2) are substantially coaxially arranged in such a manner that a portion of a member is inserted in another, portions of these members face to each other and these members are separated from each other in the radial direction. These microwave absorbing members are made of, for example, carbon, silicon carbide or the like, and are fixed alternately to the flanges. In general, each of the microwave absorbing members made of carbon, silicon carbide or the like has a specific resistance falling in a range from several Ω·cm to several kΩ·cm, and therefore should not be suitable to be used as an insulator. However, when the members are arranged alternately so as to be separated from each other in the radial direction, the microwave can be absorbed or reflected without deteriorating the withstand voltage. More specifically, the microwave m, which undesirably permeates through the insulation cylinder 14, is directed to the microwave absorbing members 21, 22 and 23, and a part of the microwave m is absorbed by them (refer to FIG. 2) and another part is reflected by them. As this operation is repeated, the microwave m is attenuated and absorbed. It should be noted that the number, shapes, arrangement of these microwave absorbing members can be appropriately selected so that the number of times of the absorption and reflection of the leaking microwave is increased, thus avoiding the leakage of the microwave to the outside.

In the operation of the gyrotron apparatus having the above-described structure, the collector 12 is grounded, and a voltage Eb (see FIG. 1) of about positive 50 kV, for example, is applied to the metal-made vacuum container 13 having the cavity resonator and the microwave reflecting-type transmitter inside. The insulation cylinder 14 maintains a sufficient electrical insulation with respect to this voltage. The unnecessary microwave remaining in the tube is reflected and absorbed respectively by the microwave reflection cylinders provided on the inner side of the insulation cylinder 14 and the microwave absorbing members arranged on the outer side, thus suppressing the leakage of the microwave to the outside. Therefore, a safe and high efficiency operation can be guaranteed. It should be noted that the microwave absorbing members arranged on the outer periphery of the insulation cylinder are essential to the present invention, and when they are combined with the microwave reflection cylinders provided on the inner side, particularly in the above-described embodiment, the leakage of the unnecessary microwave can be suppressed at a higher certainty.

Figure 3:
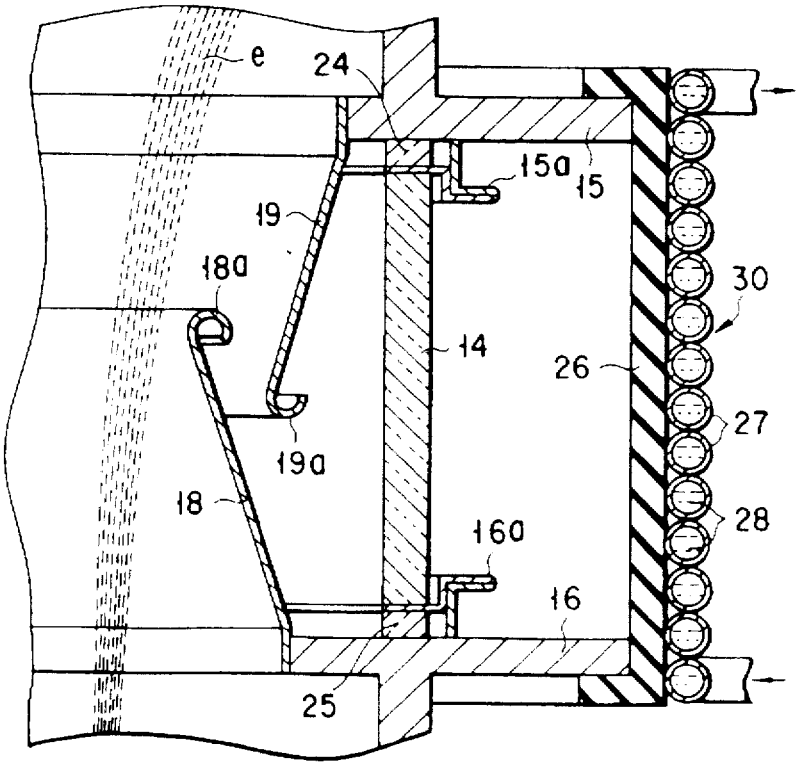
FIG. 3 is a cross section showing an enlarged view of a part of a gyrotron apparatus according to another embodiment of the present invention.

FIG. 3 shows a gyrotron apparatus according to another embodiment of the present invention. In this embodiment shown in FIG. 3, a microwave reflection cylinder 18 provided in the inner side of the insulation cylinder and on the upstream side of the beam, is formed into a conical cylinder shape which reduces its diameter gradually towards the downstream side of the beam, that is, the collector side, and the tip end of the cylinder 18 is curled to form a corona ring portion 18*a*. Further, another microwave reflection cylinder 19 is formed into a cone cylindrical shape which reduces its diameter towards the upstream side of the beam, in reverse to the above, and the tip end thereof is formed into a corona ring portion 19*a*. The reflection cylinders 18 and 19 are substantially coaxially provided in such an arrangement that they partially overlap with each other in the axial direction up to a middle portion and are separated from each other in the radial direction with a gap by the distance of which a discharge is not generated. That is, the reflection cylinders 18, 19 are so interposed between the main path of the electron beam e and the insulation cylinder 14 in such a manner that the insulation cylinder 14 cannot be directly seen through from the main path of the electron beam e. With this arrangement, the unnecessary microwave remaining in the tube is prevented from being reached to the insulation cylinder and passed through the insulation cylinder so that the leakage of the unnecessary microwave can be suppressed at a higher certainty.

Further, in this embodiment, the microwave absorbing unit 30 located outside the insulation cylinder 14, is provided around the cylindrical insulation spacer 26 which is provided around both flanges 15 and 16 and serves also as a protection cover of acryl resin or Teflon (trade name). As this microwave absorbing unit 30, a water pipe 27 which is made of a dielectric material such as Teflon, is helically wound tightly on the insulation spacer and a microwave absorbing liquid 28 such as water is circulated through the water pipe as indicated by the arrows. In this embodiment, the microwave which leaks through the insulation cylinder 14 to the atmospheric side is absorbed in the water in the pipe tightly wound the spacer, thus preventing the leakage to the outside at a higher certainty. It should be noted that the microwave absorbing liquid may be a liquid other than water.

Figure 4:
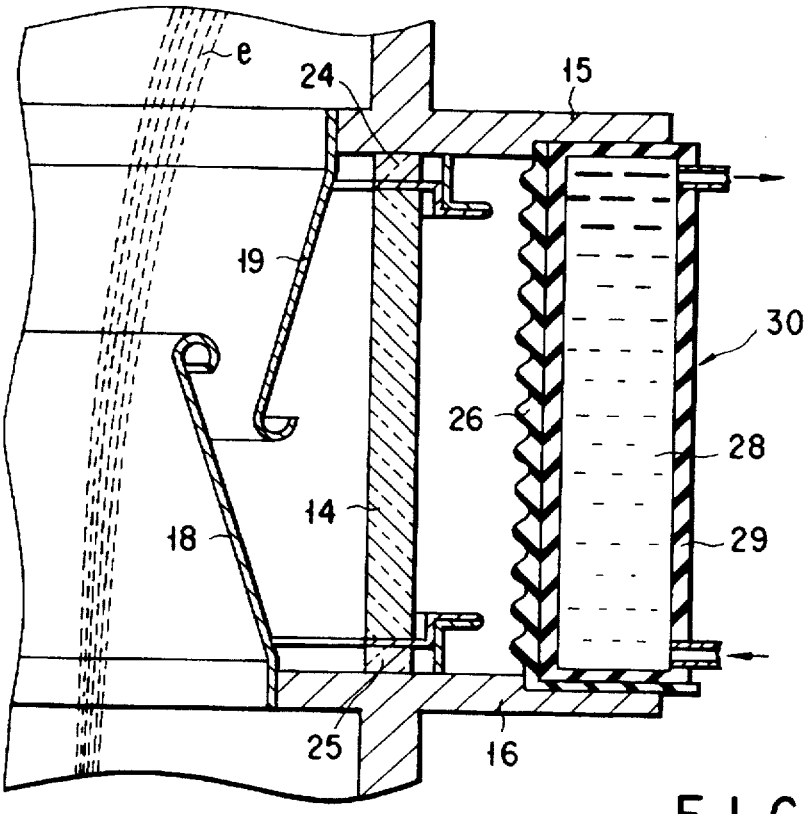
FIG. 4 is a cross section showing an enlarged view of a part of a gyrotron apparatus according to still another embodiment of the present invention.

FIG. 4 shows a gyrotron apparatus according to still another embodiment of the present invention. In this embodiment, a microwave absorbing unit 30 consisting of an insulation spacer 26 the inner surface of which is made to have a wavy shape, and a water jacket 29 made of a dielectric material, is provided to surround the insulation cylinder 14. A liquid 28 having a microwave absorbing property, such as cooling water, is circulated to the water jacket 29 as indicated by the arrows. (Also see FIG. 1.) According to this embodiment, the leaking microwave is absorbed into the water in the water jacket provided between both flanges, and around the insulation cylinder, to a greater degree than prior art devices.

Figure 5:
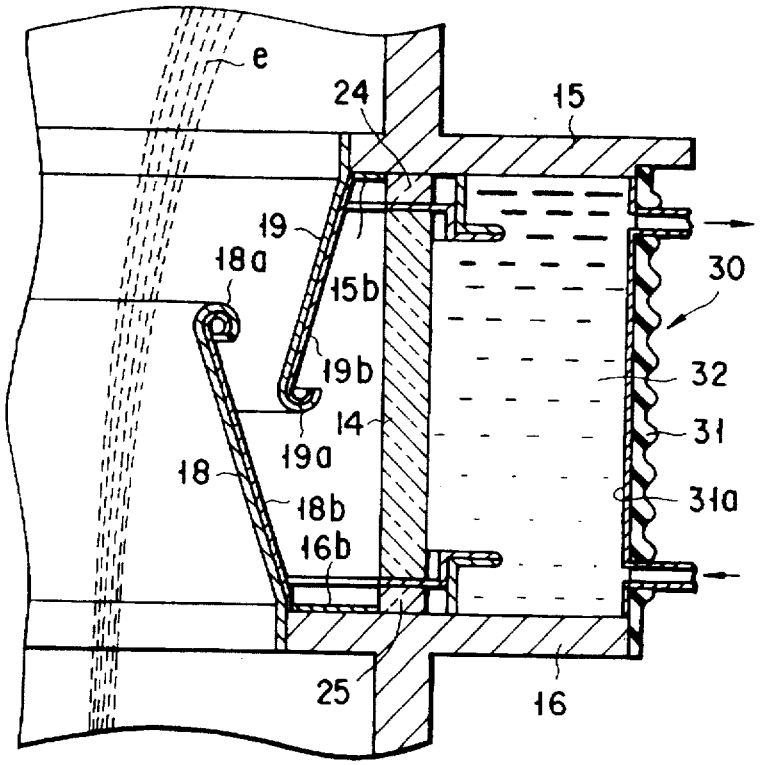
FIG. 5 is a cross section showing an enlarged view of a part of a gyrotron apparatus according to still another embodiment of the present invention.

FIG. 5 shows a gyrotron apparatus according to still another embodiment of the present invention. In this embodiment, microwave absorbing films **18*b*, 19*b*, 15*b* and 16*b* are adhered on the outer surfaces of the microwave reflection cylinders 18 and 19 provided within the insulation cylinder 14 and the surfaces of the flanges 15 and 16 which face the insulation cylinder. With this structure, even in the case where an unnecessary microwave travels from the electron beam paths to the insulation cylinder due to a diffused reflection, the unnecessary microwave is absorbed into the microwave absorbing films, and therefore the amount of the leaking microwave to the outside through the insulation cylinder 14** can be further reduced.

In this embodiment, a cylindrical jacket 31 made of an insulator is fixed between both flanges 15 and 16 around the insulation cylinder 14 in a liquid tight manner by a packing (not shown), and an insulation oil 32 having a microwave absorbing property is circulated in the space defined by the cylindrical jacket 31 and the insulation cylinder 14 as indicated by the arrows. Further, a high-resistance microwave absorbing film **31*a* is adhered to an inner surface of the cylindrical jacket 31, and thus the leakage of the unnecessary microwave to the outside can be prevented at a high certainty. According to this embodiment, the outer surface of the insulation cylinder 14** is covered by the insulation oil, and therefore the withstand voltage performance of the insulation cylinder is improved, and the length of the insulation cylinder along the axial direction can be shortened. Thus, the length of the gyrotron apparatus can be decreased.

In the above-described embodiments, the microwave reflection unit is a combination of two conductor cylinders; however the present invention is not limited to this combination, but the unit may be made of a single cylinder or a combination of three or more cylinders. Further, the unit may be formed into a different shape, and, for example, the unit may be of a structure in which a great number of strip-like conductor plates may be arranged in a ring shape. Moreover, as the microwave absorbing unit provided around the tube, any one of various types of known microwave absorbing materials can be used. Furthermore, the microwave reflection members and the microwave absorbing members of the above-described embodiments may be combined into an appropriate structure.

As described above, according to the present invention, the leakage of an unnecessary microwave to the outside from the insulation cylinder, which may occur when the apparatus is operated with a reduced potential of the collector with regard to cavity resonator, can be more surely suppressed. Therefore, a safe and high-efficiency operation can be achieved.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A gyrotron apparatus comprising:

an electron gun for generating an electron beam;

a metal housing that defines a cavity resonator in which microwaves are generated by the electron beam interacting with a microwave electric field in a magnetic field provided therein;

a microwave outputting portion for outputting microwaves generated in the cavity resonator;

a microwave reflecting-transmitting portion having a plurality of high-frequency mirrors for directing the microwaves from said cavity resonator in a direction different from a traveling direction of the electron beam and reflecting and transmitting the microwaves to the microwave outputting portion;

a collector for collecting the electron beam that travels from the electron gun through said microwave reflecting-transmitting portion;

an insulation cylinder for electrically insulating said microwave reflecting-transmitting portion from the collector, said insulating cylinder constituting a part of a vacuum chamber;

a microwave absorbing portion provided in an outer periphery of said insulation cylinder;

a first microwave reflecting cylinder for reflecting the microwaves directed thereon having a first free end and being electrically connected to the collector proximate to an end thereof opposed to said first free end; and a second microwave reflecting cylinder for reflecting the microwaves directed thereon having a second free end and being electrically connected to the metal housing proximate to an end thereof opposed to said second free end, wherein the first and second microwave reflecting cylinders are disposed substantially coaxially in opposing axial directions such that they define an interior space for the electron beam to pass through said interior space, said first free end being electrically isolated from said second free end.

2. A gyrotron apparatus according to claim 1, wherein the first and second microwave reflecting cylinders are interposed between the insulation cylinder and the path of the electron beam.

3. A gyrotron apparatus according to claim 1, wherein the first and second microwave reflecting cylinders each have an inner surface facing towards the path of the electron beam and an outer surface facing towards the insulation cylinder, and wherein at least one of the microwave reflecting cylinders has a microwave absorbing layer disposed on the outer surface thereof.

4. A gyrotron apparatus according to claim 1, wherein the microwave absorbing portion contains a liquid having a microwave absorbing property supplied in a liquid path provided so as to surround the outer periphery of the insulation cylinder.

5. A gyrotron apparatus according to claim 1, wherein the first and second microwave reflecting cylinders are disposed such that a first distance along an axial direction from the first free end to the metal housing is less than a second distance along the axial direction from the second free end to the metal housing, thus allowing the first and second microwave reflecting cylinders to eclipse, or occlude, each other at least partially.

* * * * *